US008864054B2

(12) United States Patent
Burger et al.

(10) Patent No.: US 8,864,054 B2
(45) Date of Patent: Oct. 21, 2014

(54) FUEL INJECTOR

(75) Inventors: Matthias Burger, Murr (DE); Hans-Christoph Magel, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 538 days.

(21) Appl. No.: 13/055,599

(22) PCT Filed: May 27, 2009

(86) PCT No.: PCT/EP2009/056467
§ 371 (c)(1),
(2), (4) Date: Feb. 11, 2011

(87) PCT Pub. No.: WO2010/009932
PCT Pub. Date: Jan. 28, 2010

(65) Prior Publication Data

US 2011/0139906 A1 Jun. 16, 2011

(30) Foreign Application Priority Data

Jul. 24, 2008 (DE) ..... 10 2008 040 680

(51) Int. Cl.

| | |
|---|---|
| ***F02M 61/10*** | (2006.01) |
| ***F02M 59/00*** | (2006.01) |
| ***F02M 61/00*** | (2006.01) |
| ***F02M 63/00*** | (2006.01) |
| ***F02M 47/00*** | (2006.01) |
| ***F02M 61/20*** | (2006.01) |
| ***F02M 47/02*** | (2006.01) |
| ***F02M 41/16*** | (2006.01) |
| ***F02M 61/12*** | (2006.01) |
| *F02M 57/02* | (2006.01) |

(52) U.S. Cl.

CPC ..... *F02M 47/027* (2013.01); *F02M 57/025* (2013.01); *F02M 2200/703* (2013.01); *F02M 2200/704* (2013.01); *F02M 61/12* (2013.01); *F02M 63/0005* (2013.01); *F02M 63/0015* (2013.01); *F02M 63/008* (2013.01); *F02M 2200/304* (2013.01); *F02M 2200/705* (2013.01); *F02M 2547/003* (2013.01)

USPC ..... 239/533.11; 239/88; 239/96; 239/533.2; 239/533.3; 239/533.9

(58) Field of Classification Search

CPC ..... F02M 2200/708; F02M 2200/701; F02M 2200/703; F02M 2200/704; F02M 47/027; F02M 57/025

USPC ..... 239/88–92, 533.11, 533.2, 533.3, 96

See application file for complete search history.

(56) References Cited

U.S. PATENT DOCUMENTS

| | | | | |
|---|---|---|---|---|
| 5,697,554 | A | 12/1997 | Auwaerter et al. | |
| 6,405,941 | B2 * | 6/2002 | Ganser | 239/88 |

(Continued)

FOREIGN PATENT DOCUMENTS

| | | | |
|---|---|---|---|
| DE | 19500706 | A1 | 7/1996 |
| DE | 102004005452 | A1 | 8/2005 |
| DE | 102007001363 | A1 | 7/2008 |

*Primary Examiner* — Len Tran
*Assistant Examiner* — Alexander M Valvis
(74) *Attorney, Agent, or Firm* — Michael Best & Friedrich LLP

(57) ABSTRACT

The invention relates to a fuel injector and, in particular, to a common-rail injector for injecting fuel into a combustion chamber of an internal combustion engine with a multi-part injection valve element, which can be adjusted between an open position and a closed position. A first part and a second part of the injection valve element are coupled to one another via a hydraulic coupler, which is bounded radially by a first guide for the first part and by a second guide for the second part. According to the invention, at least some sections of the first and the second guide are surrounded at their outer radii by fuel under high pressure, and the pressure realized in the hydraulic coupler is lower than the pressure radially outside the guides.

15 Claims, 2 Drawing Sheets

(56) References Cited

U.S. PATENT DOCUMENTS 6,971,592 B2 * 12/2005 Boecking ..... 239/533.2
7,083,113 B2 * 8/2006 Kropp et al. ..... 239/92
7,484,673 B2 * 2/2009 Boecking ..... 239/88
2008/0169357 A1 * 7/2008 Boecking ..... 239/91

* cited by examiner

FUEL INJECTOR

CROSS-REFERENCE TO RELATED APPLICATION

This application is a 35 USC 371 application of PCT/EP 2009/056467 filed on May 27, 2009.

BACKGROUND OF THE INVENTION

1. Field of the Invention

The invention relates to a fuel injector for injecting fuel into a combustion chamber of an internal combustion engine.

2. Description of the Prior Art

From German Patent Disclosure DE 10 2006 008 648 A1, a fuel injector embodied as a common rail injector is known that has a two-part injection valve element, which is triggerable via a control valve (servo valve). The two parts of the injection valve element are coupled to one another via a hydraulic coupler. In the state of repose of the fuel injector, rail pressure prevails in the hydraulic coupler. The known fuel injector has little leakage; that is, it is embodied with a low-pressure stage. To attain an adequate hydraulic needle closing force, a closing throttle restriction is placed in a connecting conduit that supplies a lower nozzle chamber with fuel. One disadvantage of the known fuel injector is that upon triggering of the injection valve element, the two parts of the injection valve element do not react like a single part but instead react with a delay. This can be compensated for only by very fast-switching control valves, but they entail higher costs.

OBJECT AND SUMMARY OF THE INVENTION

It is therefore the object of the invention to propose an alternative fuel injector, in which at least two injection valve element parts are coupled to one another via a low-leakage hydraulic coupler.

This object is attained with a fuel injector according to the invention described herein.

The invention is based on the concept of attaining strong pressure of the two separate injection valve element parts, which are coupled (operatively connected) by means of the hydraulic coupler, by providing that the hydraulic coupler, or more precisely a coupler chamber of the coupler, communicates, in particular lastingly, with a low-pressure source, in particular a low-pressure region of the injector that communicates with an injector return. Because of the reduced pressure inside the hydraulic coupler in comparison to the high-pressure region of the fuel injector, the injection valve element parts communicate with one another permanently and with considerable forces during the operation of the fuel injector, so that in terms of their function they can be considered to be in one piece. This effect is especially significantly advantageous in the multiple-injection mode, since in comparison with known hydraulic couplers without reduced pressure, an underpressure in the hydraulic coupler need not first be built up with the injection valve element stroke. In comparison to a one-piece injection valve element, the advantage is attained that logistics adapted to currently used production processes can be employed. Moreover, it is possible to embody the nozzle needle part of the injection valve element from a different material from that of the control rod part; as a result, the injection valve element parts can be adapted optimally to specific requirements (rigidity/strength). To minimize the leakage quantity flowing through the guide gaps that axially define the hydraulic coupler, or more precisely the coupler chamber, it is provided, in a fuel injector embodied in accordance with the concept of the invention, that both guides are surrounded radially outward, at least in some portions, with fuel that is at high pressure. In other words, the at least one injector component, radially outwardly defining the guide gaps, is surrounded, in a region radially outside the particular guide gap embodied between the at least one injector component and the injection valve element, with fuel at high pressure, as a result of which widening of the guide gaps by fuel at high pressure penetrating the guide gaps is avoided. In still other words, widening of the one injector component, or the injector components, defining the guide gaps is minimized because the pressure in the guide gaps is at least approximately precisely as great as the pressure outside the injector component or parts in a region radially outside the guide gaps. In the manner described, strong hydraulic coupling of two injection valve element parts is achieved especially elegantly, with the aid of a lesser, and in particular substantially lesser, pressure than the rail pressure than the rail pressure, without the incidence of especially high leakage quantities.

In a refinement of the invention, it is advantageously provided that inside the hydraulic coupler, a low-pressure stage is implemented, which causes a hydraulic force acting in the closing direction on the injection valve element. As a result, the injection valve element switching time can be accelerated. Since the hydraulic closing force, generated by the low-pressure stage and acting on the injection valve element, is rail-pressure-dependent, this closing force is not operative only first during the injection, as in the case of a closing throttle restriction, but permanently. It is especially preferable to dispense with an additional closing throttle restriction that reduces the fuel pressure in the vicinity of the injection valve element support in comparison to the fuel pressure in the vicinity of an inflow conduit of the fuel injector. If a closing throttle restriction were provided, the effective injection pressure would be reduced by approximately up to 150 bar. It can advantageously be dispensed with, because a low-pressure stage in the hydraulic coupler is provided. The low-pressure stage is preferably implemented such that the diameter of the injection valve element part (nozzle needle) adjacent to the nozzle hole arrangement is reduced (somewhat) in a portion defining the hydraulic coupler, in comparison to the diameter of the injection valve element part remote from the nozzle hole. In other words, the guide diameter of the guide oriented toward the nozzle hole arrangement is preferably somewhat less than the guide diameter of the other guide (in particular the upper guide) axially defining the hydraulic coupler.

An embodiment in which the hydraulic coupler is connected to a low-pressure region of the fuel injector via a connecting conduit is especially preferable. As a result, the pressure in the hydraulic coupler can be reduced considerably, in comparison to the rail pressure. In the event that the connecting conduit is embodied, at least approximately, to be free of throttle restrictions, then at least approximately low pressure prevails inside the hydraulic coupler, preferably in a pressure range between approximately 0 and 20 bar.

In a refinement of the invention, it is advantageously provided that at least one of the two guides defining the hydraulic coupler is formed by a sleevelike extension of a plate element, and this sleevelike extension is surrounded radially outward at least in some portions and preferably completely by fuel at high pressure. It is especially preferable in this respect to provide a portion of the connecting conduit, in particular as a radial conduit, in the plate element, which portion connects the hydraulic coupler with the low-pressure region of the fuel injector. Preferably, not only the aforementioned connecting conduit but also an outflow conduit from a control chamber discharge into the low-pressure region of the fuel injector; by way of the outflow conduit, when the control valve is open, fuel flows out of the control chamber in the direction of the injector return.

A construction variant that is especially preferred is one in which at least one, preferably throttle restriction-free, axial conduit is provided in the plate element, through which conduit, when the injection valve element is open, fuel can flow in the axial direction to the nozzle hole arrangement.

It is especially practical if the plate element is disposed between an (upper) injector body and a (lower) nozzle body having a nozzle hole arrangement, or in other words is braced between these housing parts. Preferably, the nozzle body is screwed to a male thread of the injector body by means of a union nut.

An embodiment in which at least one of the guides axially defining the coupler is formed by a sleeve, disposed in a high-pressure chamber and acted upon in particular by spring force, is especially preferred. An embodiment in which the sleeve is pressed by the spring in the axial direction against the aforementioned plate element is especially practical. An embodiment in which this spring is simultaneously the closing spring acting on an injection valve element part in the direction of the nozzle hole arrangement is especially preferred, in which the closing spring is braced on one end on the sleeve and on the other on the injection valve element part, in particular on a circumferential collar or securing ring of the injection valve element part.

As explained above, it is possible to put the hydraulic coupler at the low pressure present at the injector return. However, an embodiment can also be implemented in which the pressure in the hydraulic coupler is dimensioned such that, although it is below the high pressure of the fuel outside the guides that define the hydraulic coupler, nevertheless it is above the low pressure in the vicinity of the injector return. For that purpose, at least one throttle restriction is preferably disposed in the connecting conduit connecting the hydraulic coupler to the low-pressure region. The throttle restriction is adapted such that the pressure in the hydraulic coupler is higher than in the vicinity of the injector return. By the implementation of a higher (low) pressure in the hydraulic coupler in comparison to the low pressure in the injector return vicinity, the load on components in the vicinity of the hydraulic coupler is reduced. Since because of the provision of the throttle restriction in the connecting conduit, the pressure in the hydraulic coupler is now load-dependent, it is preferable, if such a throttle restriction is provided, to dispense with a low-pressure stage in the hydraulic coupler, so that the hydraulic coupler no longer has the function of generating a hydraulic closing force, but instead has coupling function only. Because of the somewhat elevated pressure in the hydraulic coupler, the already slight leakage quantity that flows through the guides into the hydraulic coupler and thus into the low-pressure region is reduced still further. The throttle restriction is preferably designed such that the pressure in the hydraulic coupler is equivalent to approximately half the rail pressure.

In that case, for generating a hydraulic closing force, a closing throttle restriction is preferably provided, which is dimensioned such that the pressure in the vicinity of the tip of the injection valve element is less, preferably by approximately 50 to 200 bar, than the rail pressure.

An embodiment in which a closing throttle restriction of this kind is disposed in an injector component that radially inward defines a control chamber is especially elegant structurally. Preferably, an inflow throttle restriction for the control chamber and an outflow throttle restriction from the control chamber, and optionally a filling throttle restriction as well for accelerated refilling of the control chamber, are preferably simultaneously placed in this injector component as well.

BRIEF DESCRIPTION OF THE DRAWINGS

Further advantages, characteristics and details of the invention will become apparent from the ensuing description of preferred exemplary embodiments as well as from the drawings. In the drawings.

DESCRIPTION OF THE PREFERRED EMBODIMENTS

Figure 1:
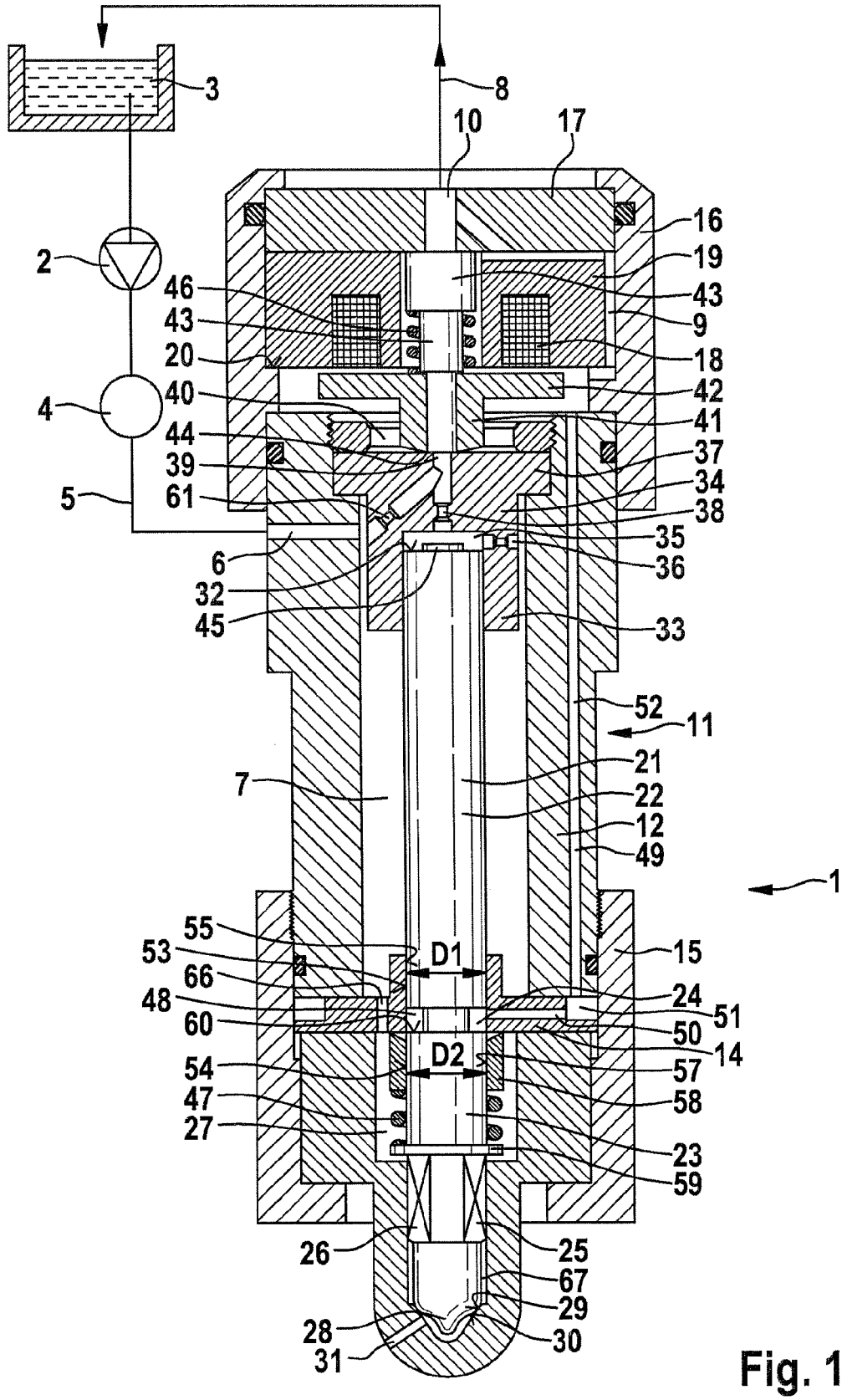
FIG. 1 shows a first exemplary embodiment of a fuel injector, having a hydraulic coupler which is connected to a low-pressure region of the fuel injector and has a low-pressure stage.

In the drawings, identical components and components having the same function are identified by the same reference numerals.

In FIG. 1, a fuel injector 1 embodied as a common rail injector is shown, for injecting fuel into a combustion chamber, not shown, of an internal combustion engine of a motor vehicle. A high-pressure pump 2 delivers fuel from a supply container 3 into a high-pressure fuel reservoir 4 also known as a common rail. In the rail, fuel, especially diesel fuel or gasoline, is stored at high pressure, which in this exemplary embodiment is above 2000 bar.

The fuel injector 1, along with other fuel injectors, not shown, is connected to the high-pressure fuel reservoir 4 via a supply line 5. The supply line 5 discharges into a supply conduit 6 of the fuel injector 1 which discharges into a high-pressure chamber 7 of the fuel injector 1. The high-pressure chamber 7 forms a mini-rail, because of which pressure fluctuations are minimized. By means of a return line 8, a low-pressure region 9 of the fuel injector 1 is connected to the supply container 3. Via an injector return port 10 and the return line 8, a control quantity, to be explained hereinafter, as well as a slight leakage quantity of fuel can flow from the fuel injector 1 to the supply container 3.

The fuel injector 1 has a housing 11, which includes an injector body 12, into which the supply conduit 6 is placed, and a lower nozzle body 13. Between the injector body 12 and the nozzle body 13, a plate element 14, to be explained hereinafter, is clamped, and the nozzle body 13 is braced against the plate element 14 by means of a union nut 15, and the plate element is consequently braced against the nozzle body 13. For that purpose, the union nut 15 is screwed to a male thread of the injector body 12.

The top part of the housing 11 is formed by a clamping nut 16, which is screwed to the injector body 12 and which braces a cap element 17 having the injector return port 10 against an electromagnet assembly 18 of an electromagnetic actuator 19, which will be explained hereinafter and which in turn rests in the axial direction on an inner shoulder 20 of the clamping nut 16.

In the housing 11, or more precisely in the injector body 12 and in the nozzle body 13, a two-part injection valve element 21 is received. It includes an upper, first part 22 (control rod)

and a lower, second part 23 (nozzle needle). The first and second parts 22, 23 of the injection valve element 21 are coupled to one another via a hydraulic coupler 24, to be explained hereinafter, and behave like a single component. The second, lower part 23 of the injection valve element 21 is guided in a guide bore 25 in the nozzle body 13. Here, axial conduits 26 are embodied on the outer circumference of the second part 23, in a region inside the guide bore 25, by way of which conduits, when the injection valve element 21 is open, fuel can flow out of the high-pressure chamber 7 into a lower annular chamber, in which essentially the same fuel pressure prevails as in the high-pressure chamber 7. To ensure this, the axial conduits 26, embodied as polished faces, and one axial conduit 66 in the plate element 14 are embodied as (at least approximately) throttle restriction-free. Consequently, the fuel pressure in an intermediate chamber 27 formed between the plate element 14 and the guide bore 25 also corresponds to the fuel pressure inside the high-pressure chamber 7. A closing throttle restriction, otherwise necessary in the prior art, is intentionally dispensed with in the exemplary embodiment of FIG. 1 (in contrast to the exemplary embodiment of FIG. 2 to be described hereinafter).

The injection valve element 21, or more precisely the second part 23, has a closing face 29 on its tip 28, with which face the injection valve element 21 can be put into tight contact with an injection valve element seat 30 (nozzle needle seat) embodied inside the nozzle body 13. When the injection valve element 21 rests on its injection valve element seat 30, or in other words is in a closing position, the escape of fuel from a nozzle hole arrangement 31 is blocked. Conversely, if it has lifted from its injection valve element seat 30 and is in an opening position, in this case a non-ballistic opening position, fuel can flow out of the high-pressure chamber 7 via the intermediate chamber 27 and the lower annular chamber 67, past the injection valve element seat 30, to the nozzle hole arrangement 31, where essentially at high pressure (rail pressure), it can be injected into the combustion chamber.

A control chamber 35 is defined by an upper face end 32 of the first part 22 of the injection valve element 21 and what in the plane of the drawing is a lower sleevelike portion 33 of an injector component 34 embodied as a throttle restriction component; the control chamber is supplied with fuel at high pressure from the high-pressure chamber 7, via an inflow throttle restriction 36 extending radially in the sleevelike portion 33. The control chamber 35 communicates with a valve chamber 39 of a control valve 40 (servo valve), via an outflow throttle restriction 38 provided in an upper, platelike portion 37 of the injector component 34. The valve chamber 39 is defined radially on the outside by a sleevelike control valve element 41, which is embodied in one piece with an armature plate 42 that cooperates with the electromagnetic actuator 19. The sleevelike control valve element 41, in its closing position, is in pressure equilibrium in the axial direction. The control chamber 35 is defined axially at the top by a guide bolt 43, which is braced axially on the cap element and has the task on the one hand of guiding the control valve element 41 in its adjustment motion and on the other of sealing off the valve chamber 39 axially at the top. From the valve chamber 39, fuel can flow into the low-pressure region 9 of the fuel injector 1, when the control valve element 41, actuatable by the electromagnetic actuator 19, has lifted from its control valve seat 44, embodied as a flat seat and disposed on the platelike portion 37 of the injector component 34; that is, when the control valve 40 is open. With the control valve 40 open, fuel flows out of the control chamber 35 via the outflow throttle restriction 38. The flow cross sections of the inflow throttle restriction 36 and outflow throttle restriction 38 are adapted to one another such that with the control valve 40 open, a net outflow of fuel (control quantity) from the control chamber 35 into the low-pressure region 9 of the fuel injector 1, via the valve chamber 39, and from the low-pressure region via the return line 8 into the supply container 3 results. As a result, the pressure in the control chamber 35 rapidly drops, causing the injection valve element 21 to experience a resulting opening force and as a consequence it strikes the top of the sleevelike portion 33. Thus the injection valve element 21 lifts from its injection valve element seat 30, so that fuel can flow out through the nozzle hole arrangement 31.

For terminating the injection event, the current supply to the electromagnet assembly 18 of the electromagnetic actuator 19 is discontinued. A control closing spring 46, braced axially on the guide bolt 43, consequently moves the sleevelike control valve element 41 back onto its control valve seat 44. By means of the replenishing fuel flowing through the inflow throttle restriction 36, the pressure in the control chamber 35 rapidly rises, and as a result the injection valve element 21, reinforced by the spring force of a closing spring 47, moves back onto its injection valve element seat 30, and in turn the fuel flow from the nozzle hole arrangement 31 into the combustion chamber is discontinued. The filling of the control chamber 35 via the inflow throttle restriction 36 is accelerated by way of a filling throttle restriction 61, which hydraulically connects the high-pressure chamber 7 to the valve chamber 39 lastingly. Optionally, this filling throttle restriction 61 can also be dispensed with.

The first and second parts 22, 23 of the injection valve element 21 are coupled to one another hydraulically in the hydraulic coupler 24, or more precisely in a coupler chamber 48, and behave like a single component. This can be ascribed to the fact that the hydraulic coupler 24, or coupler chamber 48, communicates lastingly via a multi-part connecting conduit 49 with the low-pressure region 9 of the fuel injector 1, which region is located in the injector head and thus is lastingly at low pressure during the operation of the fuel injector 1. The connecting conduit 49 is formed by a radial conduit 50, provided in the plate element 14; an annular chamber 51, radially between the plate element 14 and the union nut 15; and a vertically extending conduit 52 in the injector body 12.

In the exemplary embodiment shown, the hydraulic coupler 24 is bounded at the top in the axial direction by a first guide 53 for the first part 22 of the injection valve element 21 and axially at the bottom by a second guide 54 for the second, lower part 23 of the injection valve element 21. The first guide 53 includes a first guide gap 55 (annular gap), radially between a sleevelike extension 56 of the plate element 14 and a lower portion of the first part 22 of the injection valve element 21. Analogously, the second guide 54 includes a second guide gap 57 (annular gap) radially between a sleeve 58, acted upon by spring force by the closing spring 47, and an upper portion of the second part 23 of the injection valve element 21. A closing spring 47 is braced on one end on the lower face end of the sleeve 58 and on the other on a circumferential collar 59 of the second part 23 of the injection valve element 21.

The guide gaps 55, 57 are embodied as comparatively fuel-tight. This can be ascribed above all to the fact that the first guide 53, or more precisely the sleevelike extension 56, is disposed inside the high-pressure chamber 7, or in other words is surrounded radially on the outside by fuel that is at high pressure. As a result, the first guide gap 55 does not experience any radially outward widening as a result of the slight leakage flowing through the first guide gap 55 into the coupler chamber 48. Analogously, the second guide 54, or more precisely the sleeve 58, is disposed inside the intermediate chamber 27, in which approximately the same pressure prevails as in the high-pressure chamber 7, so that the second guide gap 57 is not widened either, because the sleeve 58 is surrounded radially on the outside by fuel at high pressure. As a consequence, the leakage quantity, flowing via the guides 53, 54 into the hydraulic coupler 24 and onward into the low-pressure region 9 via the connecting conduit 49, is slight.

In the exemplary embodiment of FIG. 1, a low-pressure stage 60 is implemented in the hydraulic coupler 24; it results in a force acting on the injection valve element 21 in the closing direction. The low-pressure stage 60 is implemented by providing that the diameter $D_I$ of the first part 22 in the vicinity of the first guide 53 is (somewhat) larger than the diameter $D_{II}$ of the second part 23 of the injection valve element 21 in the vicinity of the second guide 54. With the aid of the low-pressure stage 60, a permanently acting force, acting in the closing direction, on the injection valve element 21 is generated. As a result, the sum of all the closing forces acting on the injection valve element 21 is increased, which postpones the instant of opening of the injection valve element 21. This is decisive: For tolerance reasons, the injection valve element 21 should not open until the control valve 40 can already operate non-ballistically. Without the implemented low-pressure stage 60, the injection onset can be delayed for only a mechanically soft injection valve element 21 or a low ratio of the outflow to the inflow throttle restriction. Both provisions lead to disadvantages in terms of injector performance: While a soft injection valve element 21 makes for poorer multiple-injection suitability, a low ratio of the outflow to the inflow throttle restriction reduces the increase in the stream force of the injection stream and leads in general to disadvantages in terms of emissions.

The exemplary embodiment of a fuel injector 1 of FIG. 2 will now be described. Since essential functional and structural characteristics match the fuel injector 1 shown in FIG. 1 and described above, essentially only the differences from the exemplary embodiment shown and described above will be described below. For the common features, see FIG. 1 and the associated description.

In a distinction from the exemplary embodiment of FIG. 1, a throttle restriction 62 is integrated with the connecting conduit 49, or more precisely the radial conduit 50 between the hydraulic coupler 24 and the low-pressure region 9. This throttle restriction is designed such that in the hydraulic coupler 24, or more precisely the coupler chamber 48, approximately half the pressure prevails as the high-pressure chamber 7 and in the intermediate chamber 27. This is attained by providing that the pressure drop at the guides 53, 54 is approximately equivalent to the pressure drop at the throttle restriction 62. As a result of what in comparison to the exemplary embodiment of FIG. 1 is the elevated pressure in the coupler chamber 48, the leakage quantity flowing out via the guide gaps 55, 56 is reduced still further. Moreover, the load on components of the plate element 14 and of the sleeve 58 is reduced.

In contrast to the exemplary embodiment of FIG. 1, the diameters $D_I$ and $D_{II}$ of the first and second parts 22, 23, respectively, of the injection valve element 21 in the vicinity of the guides 53, 54 are of equal size—that is, the implementation of a low-pressure stage in the hydraulic coupler 24 has been intentionally dispensed with, since the pressure in the hydraulic coupler 24 load-dependent because of the provision of the throttle restriction 62 and thus fluctuates in operation, which would result in fluctuating closing forces in the event that a low-pressure stage were provided in the coupler 24. However, it is also conceivable to equip the exemplary embodiment of FIG. 2 with a low-pressure stage analogously to the exemplary embodiment of FIG. 1, for particular applications. Because a low-pressure stage has been dispensed with, production tolerance-dictated and/or temperature-dependent fluctuations in reference leakage at the guides 53, 54 do not affect the injector function.

Figure 2:
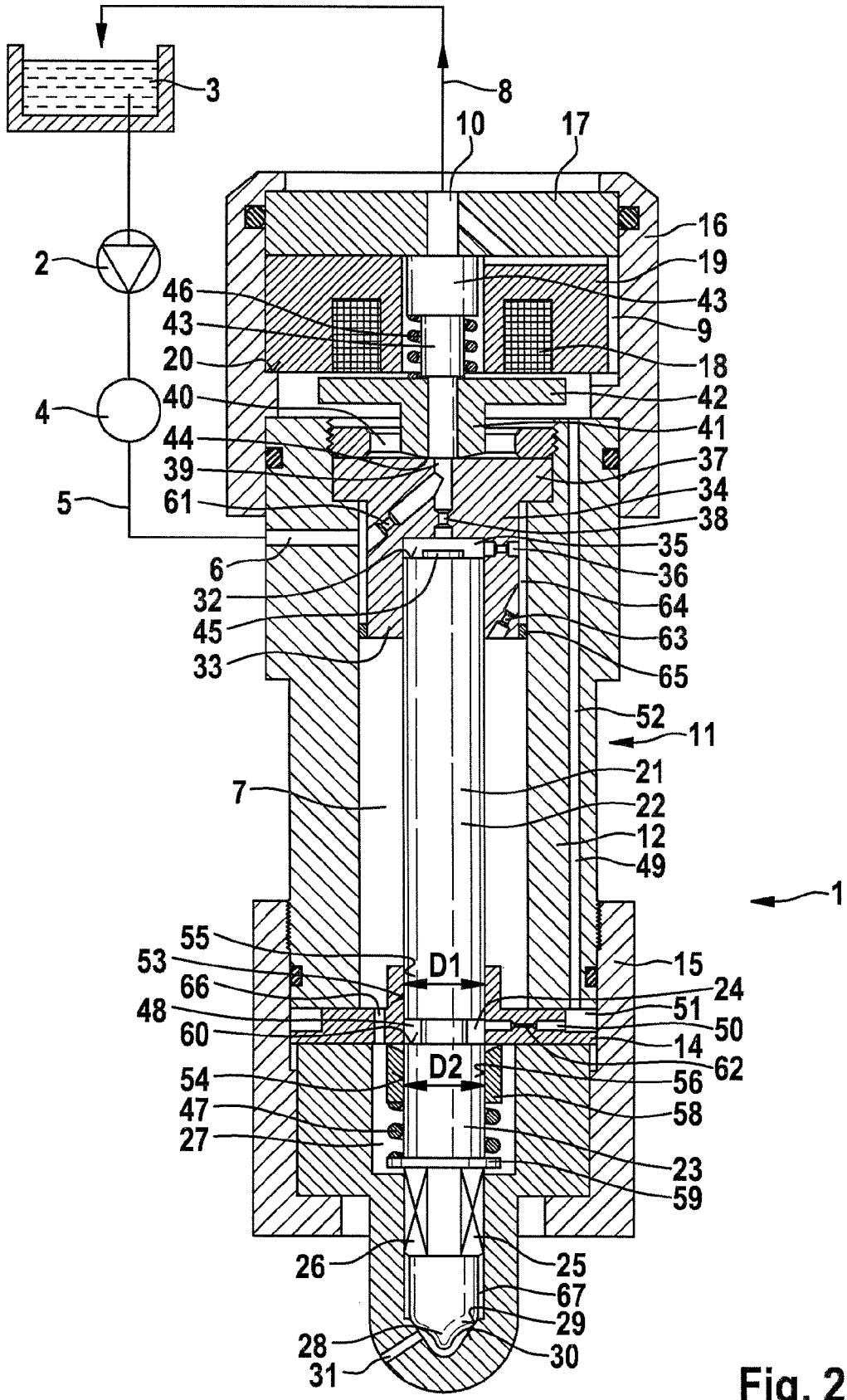
FIG. 2 shows a variant embodiment of a fuel injector, having a hydraulic coupler which is connected to a low-pressure region of the fuel injector but does not have a low-pressure stage, and having a throttle restriction, disposed in a connecting conduit between the hydraulic coupler and the low-pressure region, for adjusting the pressure in the hydraulic coupler.

To achieve a sufficiently strong hydraulic closing force despite the fact that a low-pressure stage is dispensed with, the fuel injector 1 of FIG. 2 is equipped with an additional closing throttle restriction 63, which is placed in the sleeve-like portion 33 of the injector component 34. It connects the high-pressure chamber 7 with what in comparison to FIG. 1 is an additional, annular inflow chamber 64, which radially outwardly surrounds the sleevelike portion 33, and which is sealed off via an annular sealing element 65 from the high-pressure chamber 7 serving as a mini-rail. In the exemplary embodiment shown, the closing throttle restriction 63 is designed such that the pressure in the high-pressure chamber 7 is approximately 50-200 bar less than the rail pressure in the inflow chamber 64. In contrast to the exemplary embodiment of FIG. 1, the inflow throttle restriction 36 and the filling throttle restriction 61 do not discharge from the high-pressure chamber 7 but rather from the inflow chamber 64.

The throttle restriction 62 can, as shown, be embodied as a simple throttle bore. Because of the small flow cross sections that are necessary for throttle restriction 62, however, a conventional throttle bore is comparatively difficult to make because of the tolerance. It is therefore preferred that the throttle restriction 62 be embodied as an annular gap throttle restriction. This can be implemented for instance by positioning an inlay part, such as a pin, in the actual throttle bore, past which part the fuel has to flow radially outward. The advantage of this kind of construction is the greater ease of manufacture.

The foregoing relates to the preferred exemplary embodiments of the invention, it being understood that other variants and embodiments thereof are possible within the spirit and scope of the invention, the latter being defined by the appended claims.

What is claimed is:

1. A fuel injector for injecting fuel into a combustion chamber of an internal combustion engine, the fuel injector comprising:

a multi-part injection valve element which is adjustable between an opening position and a closing position, and a hydraulic coupler which couples together a first part and a second part of the injection valve element, and which is defined axially by a first guide for the first part and by a second guide for the second part, wherein the first and second guides are at least partially surrounded radially outward with fuel at high pressure, and a lesser pressure is implemented in the hydraulic coupler than radially outside the first and second guides, the hydraulic coupler is connected to a low-pressure region of the fuel injector via a radial connecting conduit in the first guide, the first guide including an annular gap disposed adjacent a lower portion of the first part that directs fuel from a first chamber into the hydraulic coupler and the second guide including an annular gap disposed adjacent an upper portion of the second part that directs fuel from a second chamber into the hydraulic coupler, and at least one axial conduit is provided axially in the first guide connecting the first chamber and the second chamber.

2. The fuel injector as defined by claim 1, wherein in the hydraulic coupler at the injection valve element, a low-pressure stage that causes a closing force is implemented.

3. The fuel injector as defined by claim 1, wherein the first guide and/or the second guide is formed by a sleevelike extension of a plate element, into which the connecting conduit is introduced in stages.

4. The fuel injector as defined by claim 3, wherein the plate element is disposed between an injector body and a nozzle body that has a nozzle hole arrangement.

5. The fuel injector as defined by claim 1, wherein the first and/or second guide is formed by sleeve that is disposed in a high-pressure chamber.

6. The fuel injector as defined by claim 1, wherein a throttle restriction is disposed in the connecting conduit and is dimensioned such that the pressure in the hydraulic coupler is lower than the high pressure surrounding the guides and higher than the pressure in the low-pressure region.

7. The fuel injector as defined by claim 3, wherein a throttle restriction is disposed in the connecting conduit and is dimensioned such that the pressure in the hydraulic coupler is lower than the high pressure surrounding the guides and higher than the pressure in the low-pressure region.

8. The fuel injector as defined by claim 4, wherein a throttle restriction is disposed in the connecting conduit and is dimensioned such that the pressure in the hydraulic coupler is lower than the high pressure surrounding the guides and higher than the pressure in the low-pressure region.

9. The fuel injector as defined by claim 5, wherein a throttle restriction is disposed in a connecting conduit and is dimensioned such that the pressure in the hydraulic coupler is lower than the high pressure surrounding the guides and higher than the pressure in the low-pressure region.

10. The fuel injector as defined by claim 6, wherein a closing throttle restriction is provided, which is dimensioned and disposed such that the pressure in a vicinity of a tip of the injection valve element is less than the pressure in a fuel inflow conduit of the fuel injector.

11. The fuel injector as defined by claim 10, wherein the closing throttle restriction is disposed in an injector component that defines a control chamber.

12. The fuel injector as defined by claim 1, wherein the first and/or the second guide is subjected to a spring force.

13. The fuel injector as defined by claim 1, wherein the hydraulic coupler is defined radially by the first guide for the first part and by the second guide for the second part.

14. The fuel injector as defined by claim 1, wherein the hydraulic coupler is in between the first and second guides with respect to a longitudinal axis of the fuel injector.

15. The fuel injector as defined by claim 1, wherein the hydraulic coupler is substantially surrounded by the first and second guides.

* * * * *